US006796605B1

(12) United States Patent
Chu

(10) Patent No.: US 6,796,605 B1
(45) Date of Patent: Sep. 28, 2004

(54) FOLDING RECLINER

(76) Inventor: Walt Chu, 7F., No. 29-3, Sec. 4, Jen-Ai Rd., Taipei, 105 (TW)

( * ) Notice: Subject to any disclaimer, the term of this patent is extended or adjusted under 35 U.S.C. 154(b) by 0 days.

(21) Appl. No.: 10/647,574

(22) Filed: Aug. 26, 2003

(51) Int. Cl.[7] ..... A47C 4/00; A47C 4/28

(52) U.S. Cl. ..... 297/19; 297/22; 297/29; 297/354.12; 297/377

(58) Field of Search ..... 297/19, 22, 29, 297/51, 118, 354.1, 354.12, 354.13, 377, 342, 357

(56) References Cited

U.S. PATENT DOCUMENTS 1,452,869 A * 4/1923 Cattier ..... 297/118
2,450,783 A * 10/1948 Collins ..... 297/51
3,306,659 A * 2/1967 Greiner ..... 297/19
6,247,753 B1 * 6/2001 Alvestad ..... 297/342
6,679,556 B1 * 1/2004 Alvestad ..... 297/354.13

* cited by examiner

*Primary Examiner*—Anthony D. Barfield

(57) ABSTRACT

A folding recliner includes an extendable frame, a rear frame, a backrest frame, and a seat frame that have sequentially reduced widths. The rear frame is pivotally connected at two lower ends to two rear inner sides of the extendable frame, the backrest frame has two hooked upper ends for detachably engaging with one of many crossbars of the rear frame, the backrest frame is pivotally connected at lower ends to rear ends of the seat frame, and front ends of the seat frame are pivotally connected to two front inner sides of the extendable frame and a U-shaped leg. Therefore, when the recliner is fully folded, the rear frame, the backrest frame, and the seat frame are sequentially nested in the extendable frame to locate in the same plane, enabling the folded recliner to occupy the smallest possible space.

9 Claims, 5 Drawing Sheets

FOLDING RECLINER

FIELD OF THE INVENTION

The present invention relates to a folding recliner, and more particularly to a folding recliner that has a largely reduced volume after being folded, and has backrest and seat frames that can be conveniently adjusted to different inclinations.

BACKGROUND OF THE INVENTION

Most recliners are designed to include a foldable structure and an inclination-adjustable backrest. Some of the currently available recliners also include a backrest that can be steplessly adjusted to different inclination, and frames pivotally connected to each other via specially designed angular or bent joints. All these recliners have, however, the disadvantage of having a considerably large volume after being fully folded, and thereby being inconvenient for storage or packaging. Moreover, the angular or bent joint structures are too complicate to be produced at reduced cost. Taiwanese New Utility Model Patent Publication No. 173483 discloses a folding recliner that has a relatively small volume after being folded. However, since the recliner includes three seat portions having frames of the same overall width, the frames of the seat portions are sequentially stacked over one another when the recliner is in a folded state. The stacked frames of the seat portions together with a pivotally turnable cross-shaped leg structure (see FIG. 14B thereof) still produce a relatively large thickness for the folded recliner.

It is therefore tried by the inventor to develop a folding recliner that has a largely reduced volume after being fully folded, and may be easily adjusted to different inclinations.

SUMMARY OF THE INVENTION

A primary object of the present invention is to provide a folding recliner, the pivotally connected frames thereof in a folded state are nested to located in the same plane and therefore largely reduce the thickness and volume of the folded recliner to facilitate convenient storage and economical packaging thereof.

To achieve the above and other objects, the folding recliner of the present invention includes an extendable frame, a rear frame, a backrest frame, and a seat frame that have sequentially reduced widths. The rear frame is pivotally connected at two lower ends to two rear inner sides of the extendable frame, the backrest frame has two hooked upper ends for detachably engaging with one of many crossbars of the rear frame, the backrest frame is pivotally connected at lower ends to rear ends of the seat frame, and front ends of the seat frame are pivotally connected to two front inner sides of the extendable frame and a U-shaped leg.

Through changing an overall length of the connected inner and outer tubes of the extendable frame, and hooking the upper ends the backrest frame to a crossbar of the rear frame at a different height, the recliner may be adjusted to various inclinations as desired.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
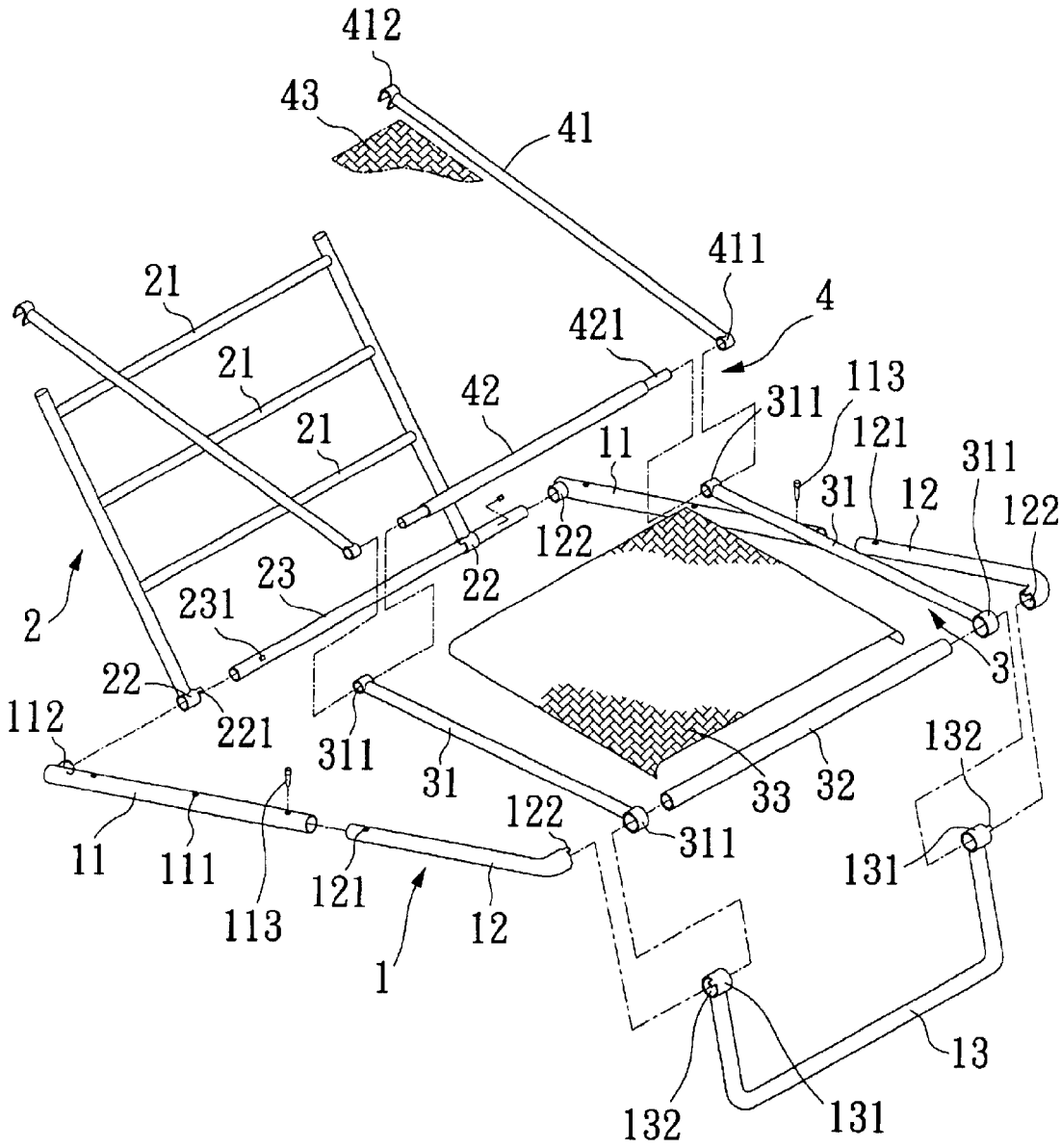
FIG. 1 is an exploded perspective view of a folding recliner according to the present invention.
Figure 2:
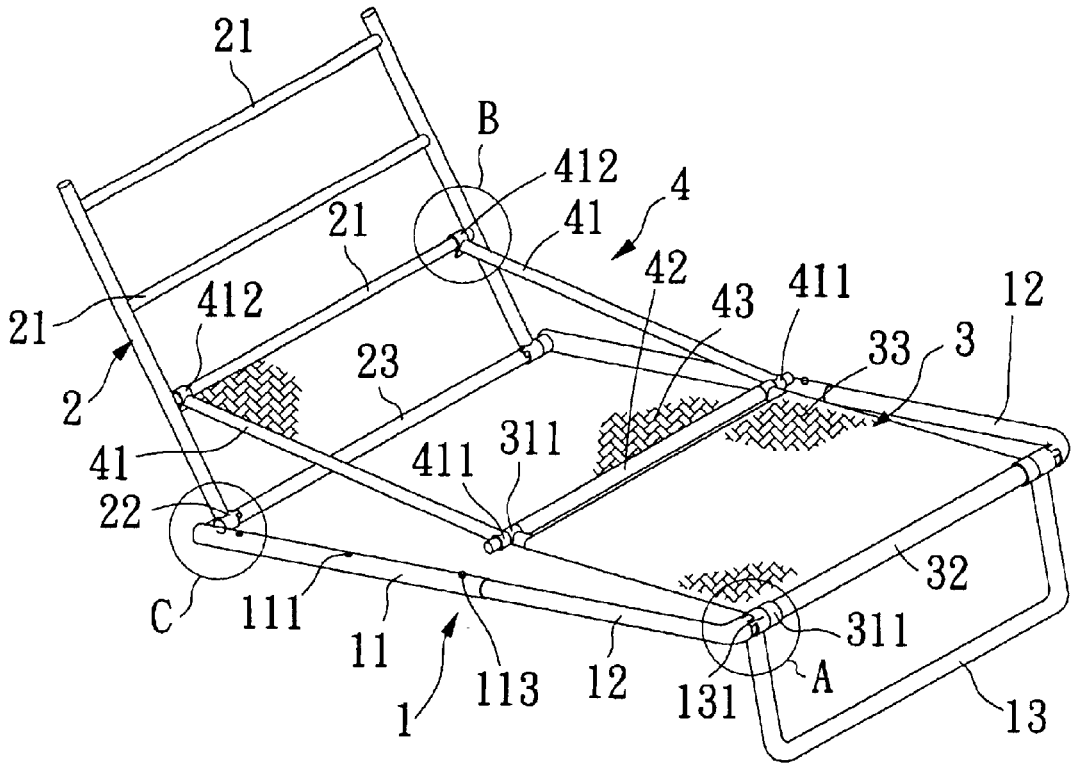
FIG. 2 is an assembled perspective view of the folding recliner of the present invention in an extended state.

Please refer to FIGS. 1 and 2 that are exploded and assembled perspective views, respectively, of a folding recliner according to the present invention. As shown, the folding recliner includes an extendable frame 1, a rear frame 2, a seat frame 3, and a backrest frame 4.

The extendable frame 1 includes two outer tubes 11, two inner tubes 12 telescopically received in the two outer tubes 11, and a U-shaped leg 13. The two outer tubes 11 are provided at predetermined positions with a plurality of adjusting holes 111, and at two rear ends with two pivot sleeves 112 radially extended toward each other. Rear ends of the two inner tubes 12 have an outer diameter matching with an inner diameter of front ends of the two outer tubes 11. A locating hole 121 is provided near the rear end of each inner tube 12. A tapered insertion pin 113 may be extended through any one of the adjusting holes 111 and the locating hole 121 to connect the outer and the inner tube 11, 12 to one another. Front ends of the two inner tubes 12 are bent by 90 degrees to face toward one another. Each of the right-angled front ends of the inner tubes 12 is provided at a predetermined position on an outmost edge thereof with a first stopper 122. The U-shaped leg 13 is provided at two upper ends with two pivot rings 131, two outer ends of which are provided at predetermined positions with two second stoppers 132.

Figure 5:
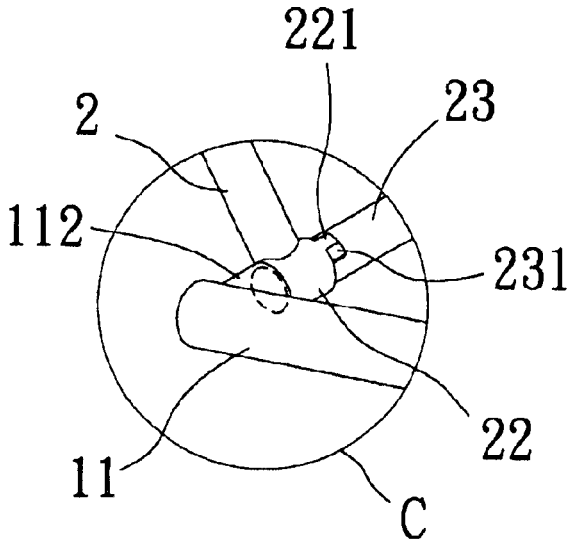
FIG. 5 is an enlarged perspective view of the circled area C of FIG. 2.

The rear frame 2 is functionally a supporting frame located at a rear side of the folding recliner, and includes a plurality of crossbars 21 spaced between two side members. The two side members are provided at respective lower end with a pivot ring 22, so that a first pivot shaft 23 is extended at two ends through the two pivot rings 22 to engage with the pivot sleeves 112 on the rear ends of the extendable frame 1, as shown in FIG. 5. The two pivot rings 22 are provided at two inner ends facing toward each other with an axially projected third stopper 221 each, and the first pivot shaft 23 is provided near two ends adjacent to the third stoppers 221 with two fourth stoppers 231.

Figure 3:
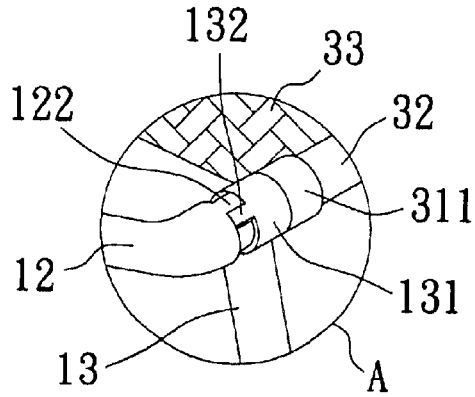
FIG. 3 is an enlarged perspective view of the circled area A of FIG. 2.

The seat frame 3 includes two side bars 31 and a second pivot shaft 32. The two side bars 31 are provided at respective front and rear ends with two pivot rings 311, and a seat 33 is connected to and stretched between the two side bars 31. Two ends of the second pivot shaft 32 are sequentially movably extended through the two front pivot rings 311 on the side bars 31, the two pivot rings 131 on the upper ends of the U-shaped leg 13, and the bent front ends of the two inner tubes 12 of the extendable frame 1, as shown in FIG. 3.

The backrest frame 4 includes two hooking bars 41 and a third pivot shaft 42. Each of the hooking bars 41 is provided at lower and upper ends with a pivot ring 411 and a hook 412, respectively. The third pivot shaft 42 has two stepped outer ends to form two reduced sections 421, which are sequentially extended through the two upper pivot rings 311 on the seat frame 3 and the two pivot rings 411 on the backrest frame 4. A backrest 43 is connected to and stretched between the two hooking bars 41.

Figure 4:
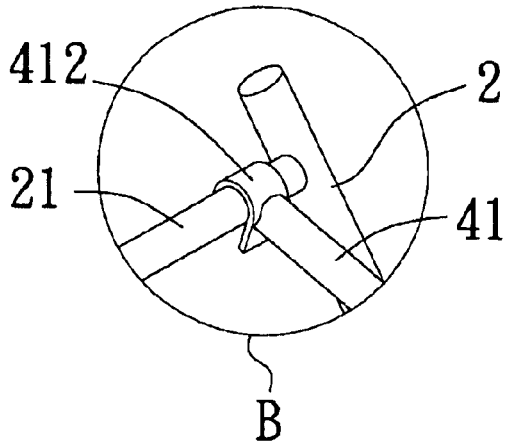
FIG. 4 is an enlarged perspective view of the circled area B of FIG. 2.

Please refer to FIG. 2. The seat and the backrest frames 3, 4 are pivotally connected to each other with the hooks 412 on the upper ends of the two hooking bars 41 located at a desired crossbar 21 on the rear frame 2, as shown in FIG. 4.

Figure 6:
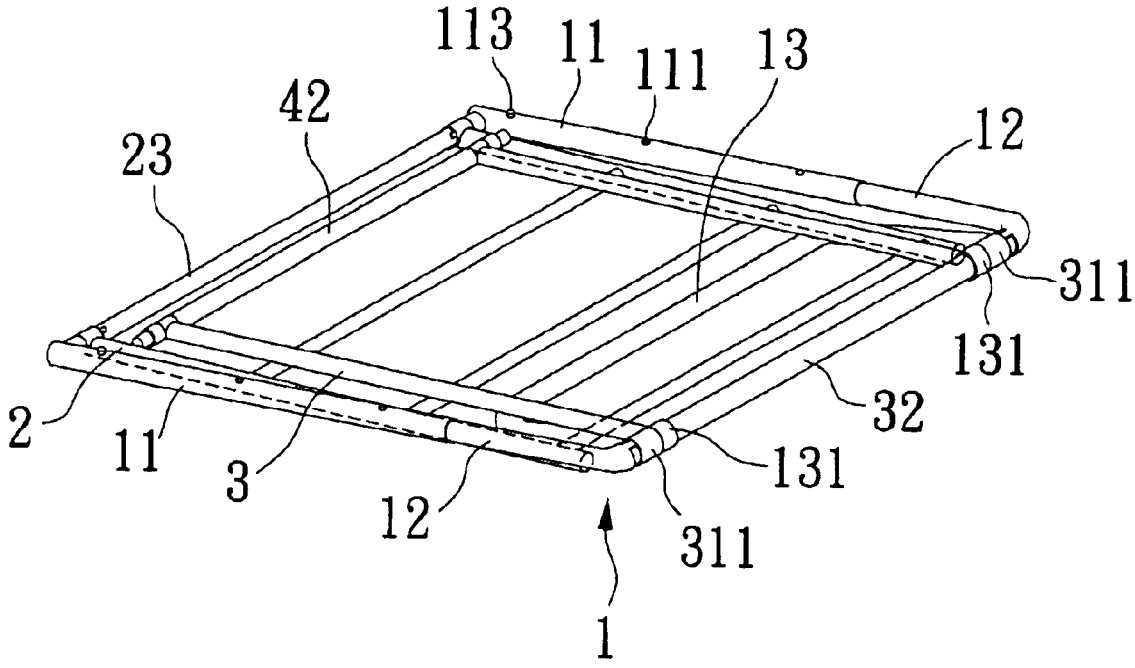
FIG. 6 is a perspective view of the folding recliner of the present invention in a fully folded state.

With the above-described structure, the rear frame 2, the backrest frame 4, and the seat frame 3 may be sequentially assembled to the extendable frame 1 to locate between the two outer and inner tubes 11, 12. By forward turning the rear frame 2 about the first pivot shaft 23 and backward turning the leg 13 about the second pivot shaft 32, the whole folding recliner may be folded with the frames 2, 4, and 3 completely nested in the frame 1, as shown in FIG. 6, so that the folded recliner has a minimum thickness to occupy the smallest possible space and to facilitate storage or packaging thereof.

Please refer to FIG. 3. To extend the folded recliner for use, first outward turn the leg 13 about the second pivot shaft 32 until the second stoppers 132 is abutted on the first stoppers 122. Then, outward turn the rear frame 2 about the first pivot shaft 23 until the third stoppers 221 are abutted on the fourth stoppers 231, as shown in FIG. 5. Thereafter, engage the hooks 412 of the backrest frame 4 with a desired crossbar 2 on the rear frame 2, as shown in FIG. 4. And, the recliner is easily and effortlessly extended for use.

Figure 7:
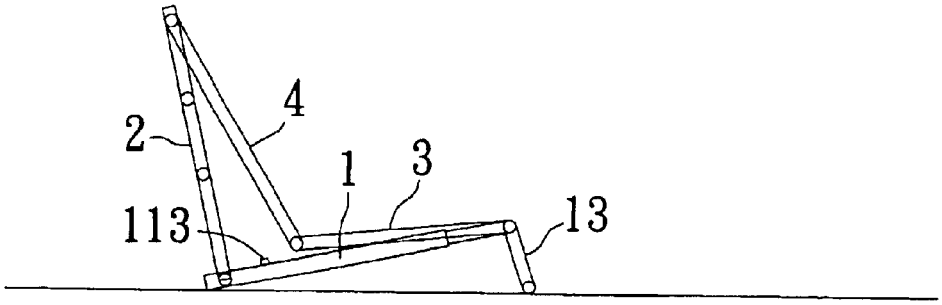
FIGS. 7 to 9 shows the folding recliner of t the present invention is adjusted to locate a backrest frame at different inclinations.
Figure 8:
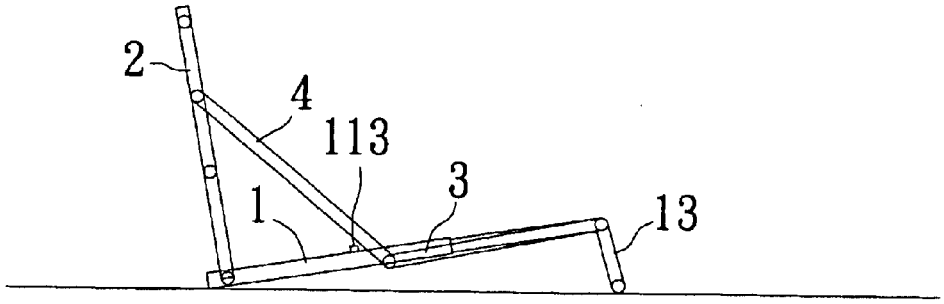
Figure 9:
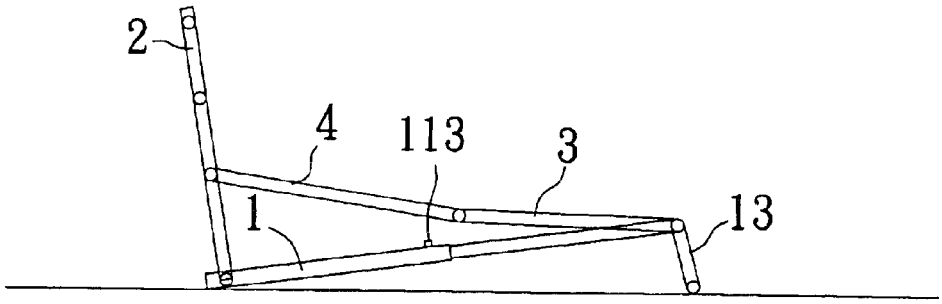

Please refer to FIGS. 7 to 9. When it is desired to adjust inclinations of the seat and the backrest frame 3 and 4, first disengage the hooks 412 from the crossbar 21, and insert the insertion pins 113 into selected adjusting holes 111 and the locating holes 121 to adjust and change an overall length of the outer tubes 11 and the inner tubes 12 of the extendable frame 1. Then, lift the seat and the backrest frames 3, 4 at the same time for the hooks 412 to engage with a crossbar 21 corresponding to the adjusted overall length of the extendable frame 1.

What is claimed is:

1. A folding recliner, comprising an extendable frame, a rear frame, a seat frame, and a backrest frame;

said extendable frame including two outer tubes, two inner tubes telescopically received in said outer tubes, and a leg; said outer tubes being provided at predetermined positions with a plurality of adjusting holes, and at two rear ends with two pivot sleeves radially extended toward each other; rear ends of said two inner tubes having an outer diameter matching with an inner diameter of front ends of said two outer tubes, and a locating hole being provided near the rear end of each said inner tube, such that an insertion pin may be extended through any one of said adjusting holes and said locating hole to connect said outer and said inner tube to one another; and said leg being provided at two upper ends with two pivot rings;

said rear frame including a plurality of crossbars spaced between two side members, said two side members being provided at respective lower end with a pivot ring, so that a first pivot shaft is extended at two ends through said two pivot rings to engage with said pivot sleeves on the rear ends of said extendable frame;

said seat frame including two side bars and a second pivot shaft, said two side bars being provided at respective front and rear ends with two pivot rings, and two ends of said second pivot shaft being sequentially movably extended through said two front pivot rings on said side bars, said two pivot rings on said upper ends of said leg, and front ends of said two inner tubes of said extendable frame; and said backrest frame including two hooking bars and a third pivot shaft, each of said hooking bars being provided at lower and upper ends with a pivot ring and a hook, respectively; two ends of said third pivot shaft being sequentially extended through said pivot rings at rear ends of said two side bars of said seat frame and said pivot rings at lower ends of said hooking bars, so that said back rest frame is pivotally turnably connected to said seat frame; and said hooks at upper ends of said hooking bars being detachably engaged with a selected one of said crossbars of said rear frame;

whereby said rear frame, said backrest frame, and said seat frame are sequentially pivotally connected to and located between said two outer and inner tubes of said extendable frame, and when said rear frame is forward turned about said first pivot shaft and said leg is backward turned about said second pivot shaft, said folding recliner may be fully folded with said rear frame, said backrest frame, and said seat frame completely nested in said extendable frame in the same one plane, so that said folded recliner has a smallest possible thickness to occupy a smallest possible space and to facilitate convenient storage or economical packaging thereof.

2. The folding recliner as claimed in claim 1, wherein said insertion pins are tapered pins.

3. The folding recliner as claimed in claim 1, wherein said two pivot rings on said rear frame are provided at two inner ends facing toward each other with an axially projected stopper.

4. The folding recliner as claimed in claim 1, wherein said first pivot shaft of said rear frame is provided near two ends at predetermined positions with two stoppers.

5. The folding recliner as claimed in claim 1, wherein said two side bars of said seat frame have a seat connected thereto and stretched therebetween.

6. The folding recliner as claimed in claim 1, wherein said two hooking bars of said backrest frame have a backrest connected thereto and stretched therebetween.

7. The folding recliner as claimed in claim 1, wherein said third pivot shaft on said backrest frame has two stepped outer ends to form two reduced sections, onto which said pivot rings at the two rear ends of said seat frame and said pivot rings at the two lower ends of said backrest frame are sequentially mounted.

8. The folding recliner as claimed in claim 1, wherein each of said inner tubes of said extendable frame is provided at the front end with a projected stopper.

9. The folding recliner as claimed in claim 1, wherein each of said pivot rings on said leg is provided at an outer end with a stopper.

* * * * *